US009255455B2

(12) United States Patent
Mathis

(10) Patent No.: US 9,255,455 B2
(45) Date of Patent: Feb. 9, 2016

(54) DRILL CUTTINGS TREATMENT SYSTEM

(71) Applicant: CONFLUENCE ENERGY, LLC, Kremmling, CO (US)

(72) Inventor: Mark Joseph Mathis, Silverthorne, CO (US)

(73) Assignee: Confluence Energy, LLC, Kremmling, CO (US)

( * ) Notice: Subject to any disclaimer, the term of this patent is extended or adjusted under 35 U.S.C. 154(b) by 137 days.

(21) Appl. No.: 14/133,292

(22) Filed: Dec. 18, 2013

(65) Prior Publication Data

US 2014/0175008 A1 Jun. 26, 2014

Related U.S. Application Data

(60) Provisional application No. 61/738,942, filed on Dec. 18, 2012.

(51) Int. Cl.
*E21B 21/00* (2006.01)
*E21B 21/06* (2006.01)

(52) U.S. Cl.
CPC ..... *E21B 21/066* (2013.01)

(58) Field of Classification Search
None
See application file for complete search history.

(56) References Cited

U.S. PATENT DOCUMENTS 8,318,027 B2 * 11/2012 McGuire ..... C02F 1/004 210/151
8,389,270 B1 * 3/2013 Mathis ..... B09C 1/10 435/262.5
2014/0048479 A1 * 2/2014 Hallett ..... E21B 21/066 210/602

FOREIGN PATENT DOCUMENTS

CN 2695633 Y * 4/2005

OTHER PUBLICATIONS

Mitchell, "A bug in the system," CALS News, Feb. 28, 2011.*
Hawk, (a response to the article "Real Bioremediation Solutions,"), oilspilltruth.wordpress.com, May 25, 2010.*

* cited by examiner

*Primary Examiner* — Chester Barry
(74) *Attorney, Agent, or Firm* — Polsinelli PC

(57) ABSTRACT

Aspects of the present disclosure also involved a method of processing waste, such as drill cuttings, involving the operations of receiving a waste material comprising a liquid material and a solid material, the waste material received directly from a source wherein the waste material is warm. The source may be a drilling operation and the waste material may be drill cuttings from the drilling operation. The method further involving pumping the warm waste material to a separation mechanism, such as a dryer, that separates a portion of the solid material (e.g., cuttings) from a portion of the liquid material (e.g., drilling fluid). The method may further involve mixing the separated solid material with a bioremediation agent.

12 Claims, 8 Drawing Sheets

DRILL CUTTINGS TREATMENT SYSTEM

CROSS REFERENCE TO RELATED APPLICATION

This application claims priority under 35 U.S.C. §119 from U.S. provisional application No. 61/738,942 entitled "DRILL TREATMENT CUTTINGS SYSTEM," filed on Dec. 18, 2012, the entire contents of which are fully incorporated by reference herein for all purposes.

TECHNICAL FIELD

Aspects of the present disclosure involve drill cuttings treatment systems and methods.

BACKGROUND

Drilling an oil or natural gas well involves drilling a hole into the Earth with a drill string and a drill bit. The drill string, which includes sections of pipe, is hollow so that drilling fluid may be pumped down to the drill head to perform several functions including cooling the drill bit and carrying drill cuttings out of the bore hole and to the surface. The drill cuttings returning to the surface cannot simply be dumped on site or otherwise disposed of without treatment and processing. Similarly, the drilling fluid conveying the cuttings to the surface has value and it is not desirable to simply discard the fluid.

It is with these issues in mind, among others, that aspects of the present disclosure were conceived.

SUMMARY

Aspects of the present disclosure involve a drill cuttings treatment system involving a drill cuttings separation mechanism, such as a shaker, dryer, and or centrifuge, configured to separate a fluid from drill cuttings and a mixing mechanism configured to receive a bioremediation agent, which may include wood particles derived from a mountain pine beetle-infected wood source, and mix the bioremediation agent with the separated drill cuttings.

Aspects of the present disclosure also involved a method of processing waste, such as drill cuttings, involving the operations of receiving a waste material comprising a liquid material and a solid material, the waste material received directly from a source wherein the waste material is warm. The source may be a drilling operation and the waste material may be drill cuttings from the drilling operation. The method further involving pumping the warm waste material to a separation mechanism, such as a dryer, that separates a portion of the solid material (e.g., cuttings) from a portion of the liquid material (e.g., drilling fluid). The method may further involve mixing the separated solid material with a bioremediation agent.

Aspects of the method also involve recirculating separated liquid material to the received waste material. In one example, the mixture of recycled liquid material and the received waste material forms a 45% to 95% aqueous solution mixture. In another example, the mixture is between 50 and 70%. Aspects of the method also involve processing the separated solid material with a surfactant. Aspects of the method also involve mixing the solid material with a bioremediation agent that may include wood particles derived from a mountain pine beetle-infected wood source.

Aspects of the present disclosure further involve a waste treatment system including a mobile platform, such as a trailer, that supports a sink on the mobile platform, where the sink is configured to received waste material, which may be received directly from the shakers of a drilling rig during a drilling operation. The treatment system further involves a conveyance mechanism, such as a pump, coupled with the sink for receiving waste material from the sink, and where the conveyance mechanism moving the waste material to a separator (e.g., a dryer). The separator receives the waste material and separates a portion of fluid waste (e.g., drilling fluid) from solid waste (e.g., drill cuttings), such that the solid waste is deposited in a storage bin portion of the mobile platform.

The waste treatment apparatus may further include a conduit and valve assembly that directs a portion of the separated portion of the drilling fluid to the sink to wet the received waste material. The sink may be positioned to directly receive waste material from a shaker of a drilling rig, the shaker providing warm waste material directly from a drilling operation. When deploying a pump as a conveyance mechanism, the pump delivers warm waste material to the dryer, the waste material wetted with the separated portion of the drilling fluid. The waste material is wetted to a level that allows the pump to maintain a substantially constant flow of wetted cuttings to the dryer.

BRIEF DESCRIPTION OF THE DRAWINGS

Example embodiments are illustrated in referenced figures of the drawings. It is intended that the embodiments and figures disclosed herein are to be considered illustrative rather than limiting.

DETAILED DESCRIPTION

Aspects of the present disclosure involve a system, apparatus and method for treating drill cuttings. The term "drill cuttings" describes the material that is removed from a borehole for oil, gas, and other forms of wells while the borehold is being drilled. Often, drill cuttings may be carried to the surface with drilling fluid, and are therefore either naturally or due, at least in part to the inclusion of drilling fluid, of a muddy consistency with both liquids and hard solid materials. The drilling fluid may include oil-based fluids, synthetic drilling fluid, water based drilling fluid and other drilling fluids. Hence, drill cuttings often contain hydrocarbons, chemicals and other material that requires some form of processing before the drill cuttings can be buried, left on site or otherwise disposed.

Figure 1:
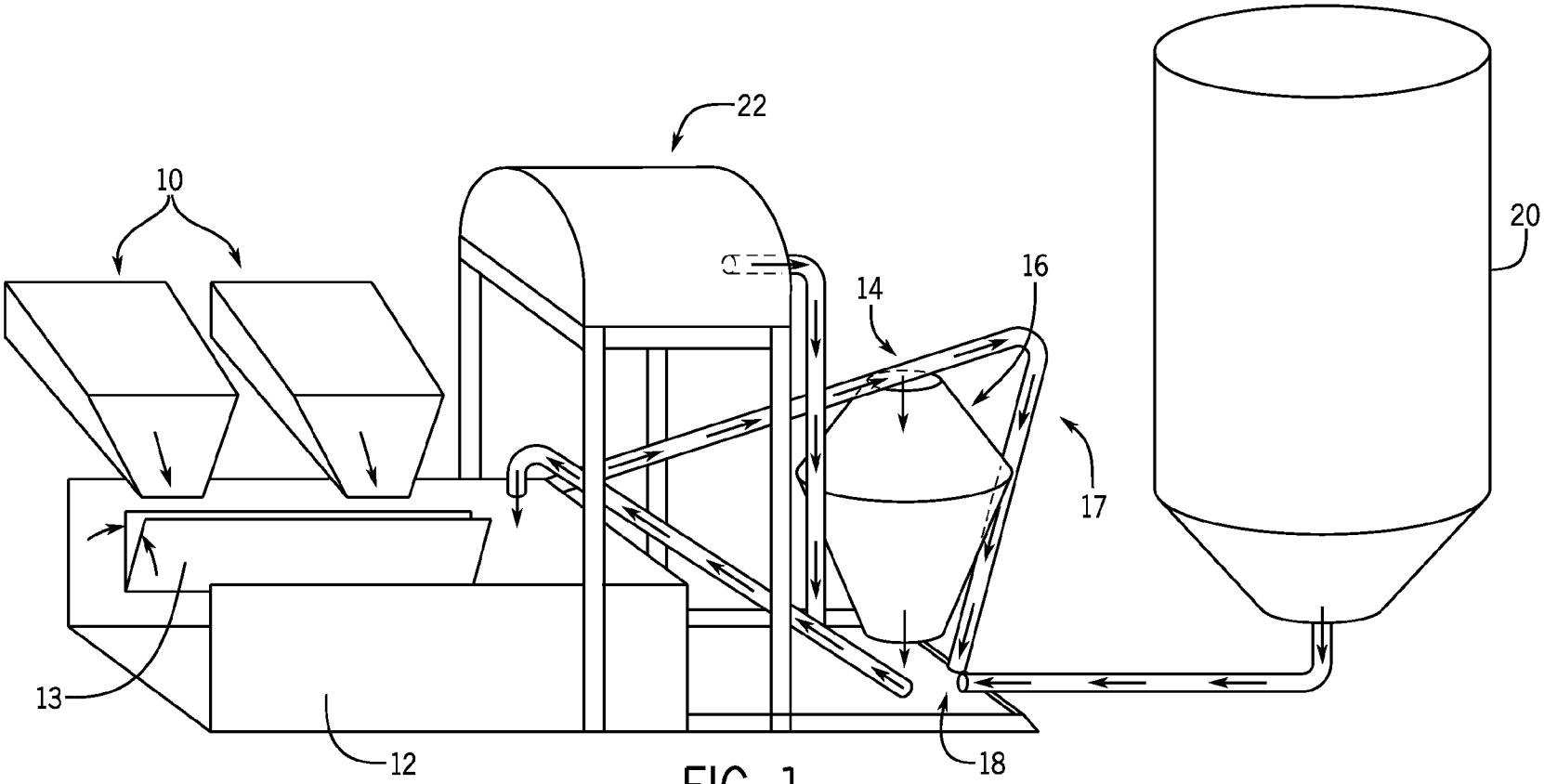
FIG. 1 is a diagram of one possible example of a drill cuttings treatment system, according to one embodiment.
Figure 2:
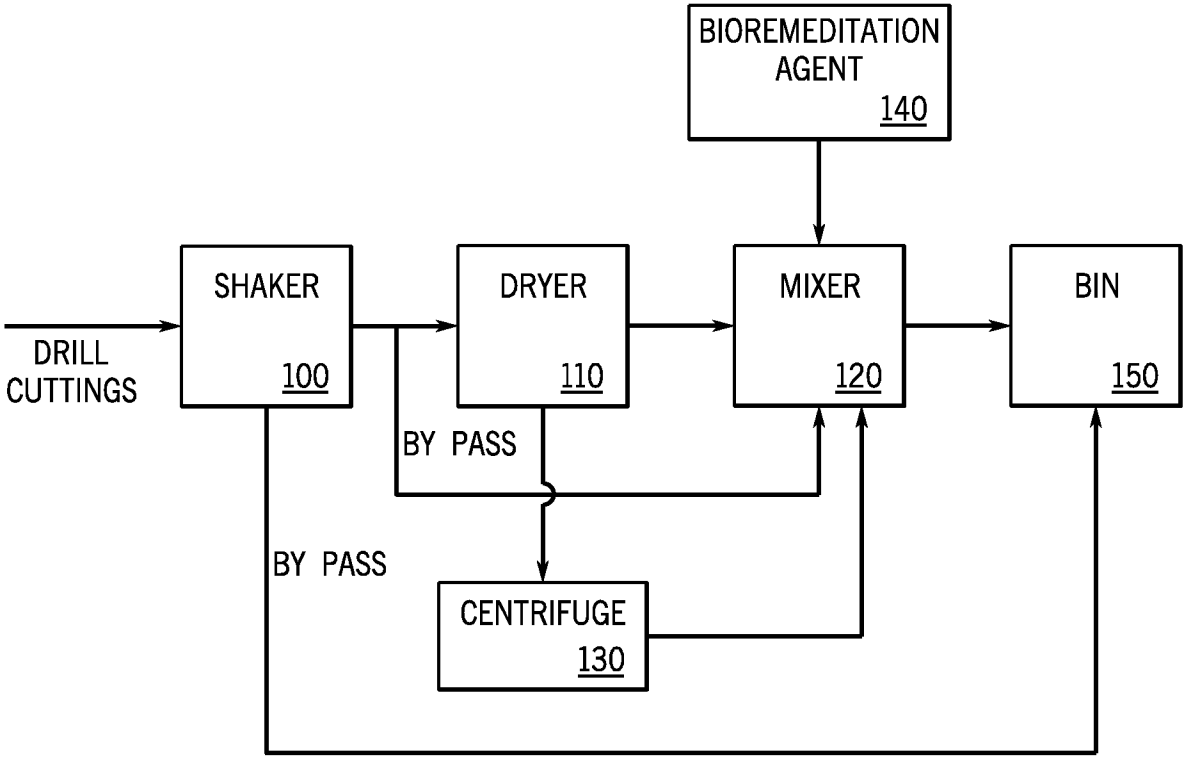
FIG. 2 is a process flow diagram illustrating one possible method of treating drill cuttings, according to one embodiment.
Figure 3:
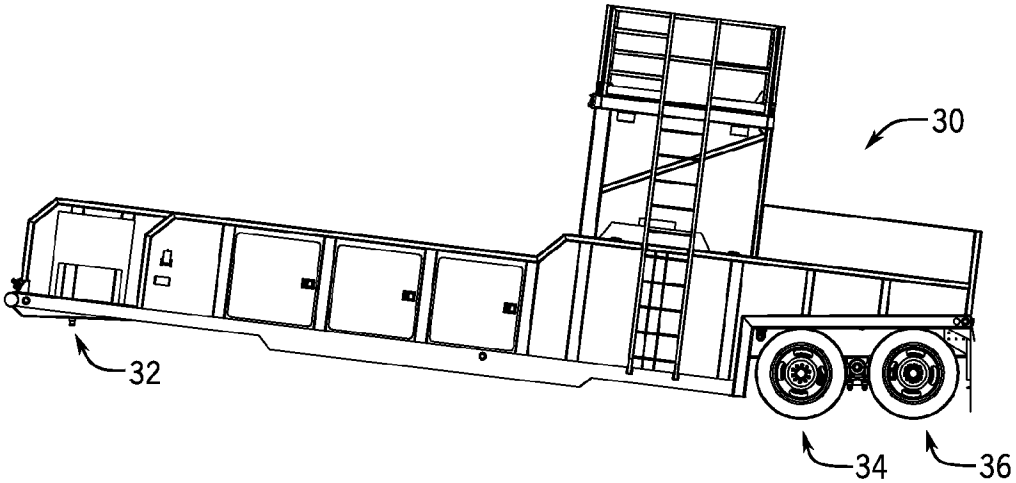
FIG. 3 is a left side view of a trailer containing a drill cuttings treatment system, according to one embodiment, with the trailer positioned for be towed to a drill rig.
Figure 4:
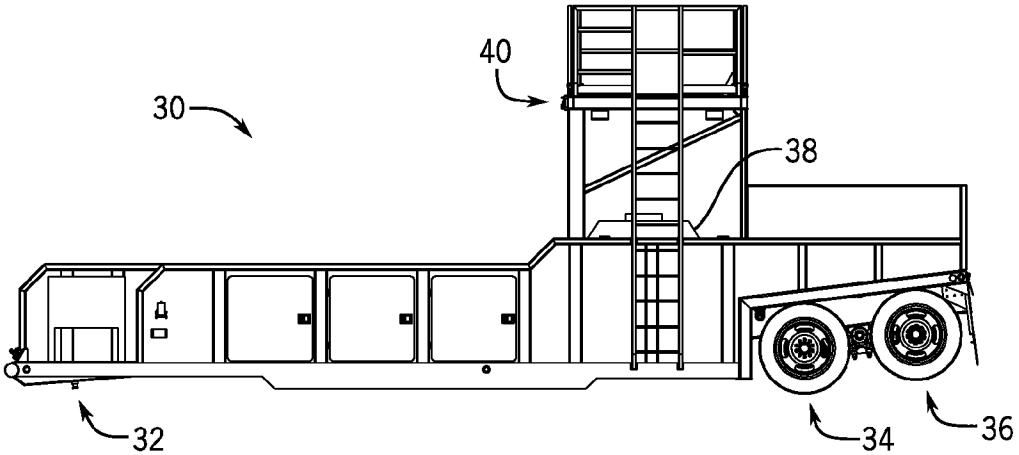
FIG. 4 is a left side view of the trailer of FIG. 3, with the trailer positioned for receiving drill cuttings from a drilling rig, according to one embodiment.
Figure 5:
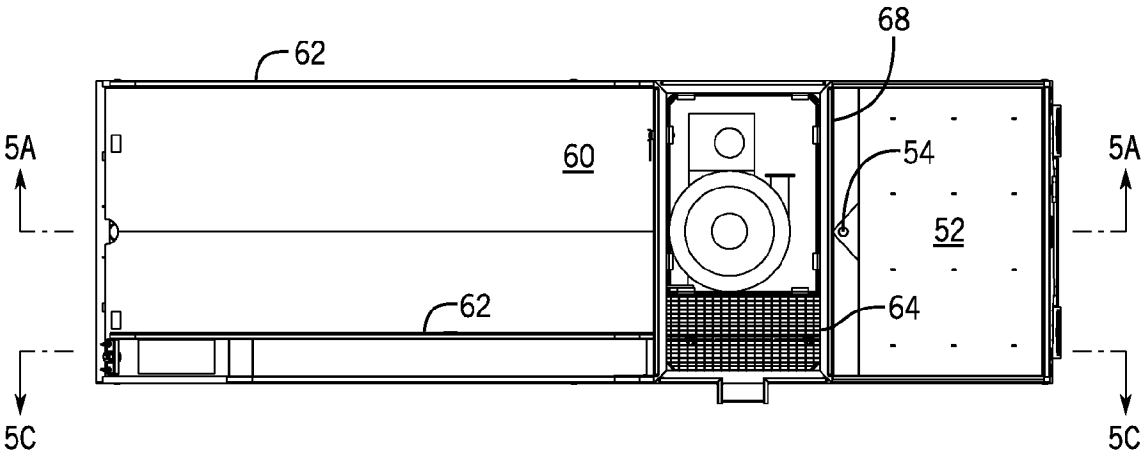
FIG. 5 is a top view of the trailer and system of FIG. 3.
Figure 5A:
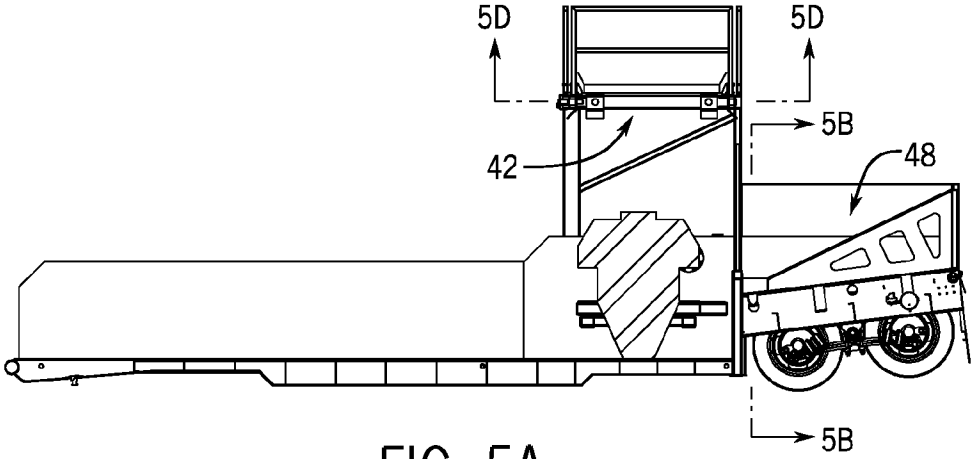
FIG. 5A is a section view taken along line A-A of FIG. 5.
Figure 5B:
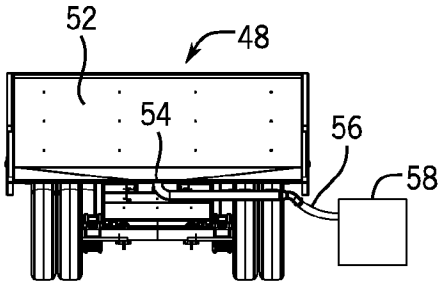
FIG. 5B is a section view taken along line B-B of FIG. 5.
Figure 5C:
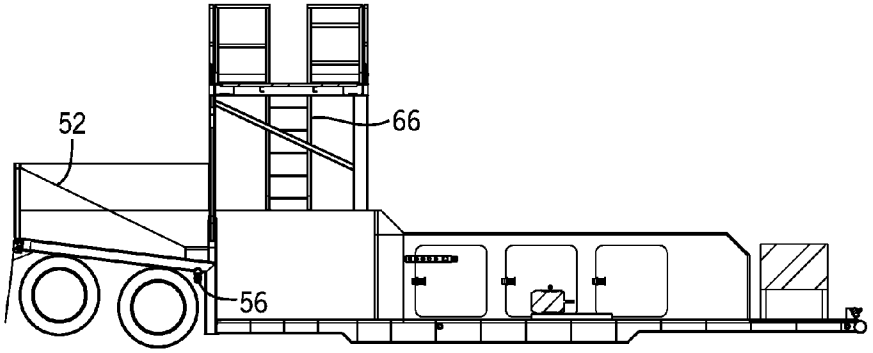
FIG. 5C is a section view taken along line C-C of FIG. 5.
Figure 5F:
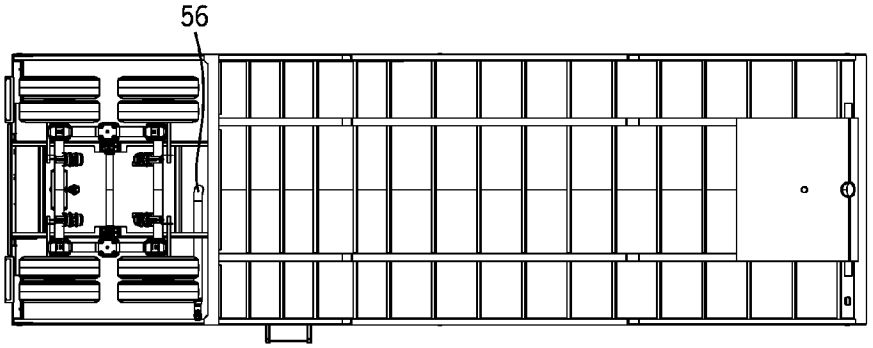
FIG. 5F is a bottom view of the trailer and system of FIG. 4.
Figure 5E:
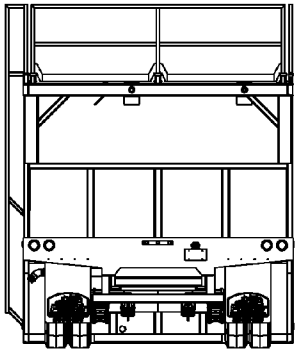
FIG. 5E is a rear view of the trailer and system of FIG. 4.
Figure 5D:
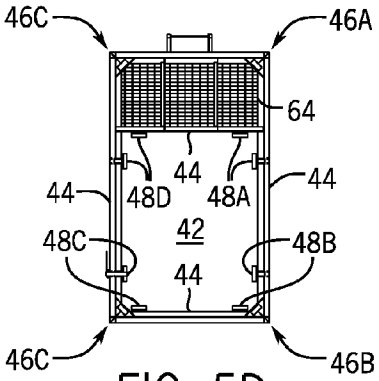
FIG. 5D is a section view taken along line D-D of FIG. 5.
Figure 6A:
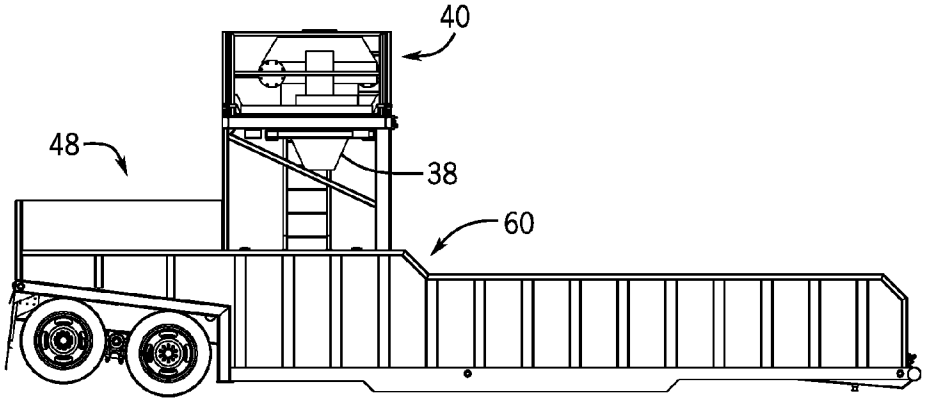
FIG. 6A is a right side view of the trailer of FIG. 4, with a dryer moved from the position of FIG. 3 (hauling) to an operating position in a dryer tower.
Figure 6B:
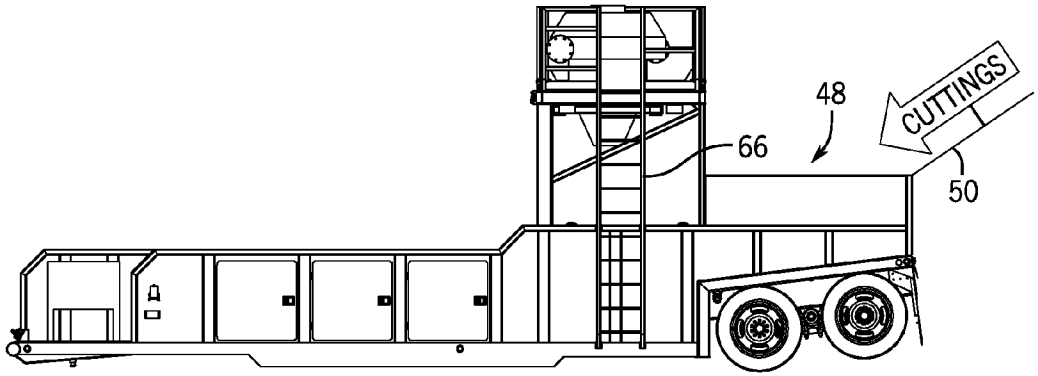
FIG. 6B is a left side view of the trailer and system as configured in FIG. 6A.
Figure 6D:
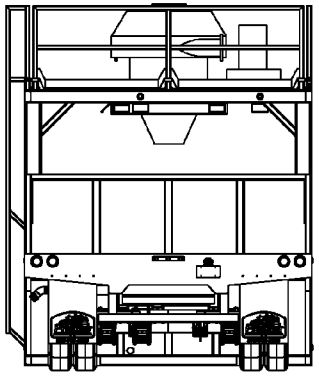
FIG. 6D is a rear view of the trailer and system as configured in FIG. 6A.
Figure 6C:
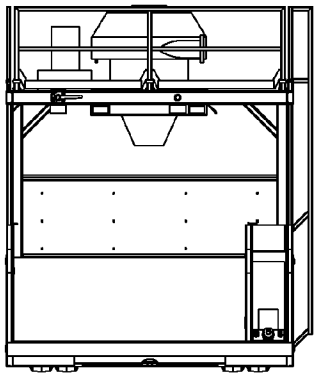
FIG. 6C is a front view of the trailer and system as configured in FIG. 6A.

Aspects of the present disclosure involve introducing a bioremediation material and/or a surfactant into a drill cuttings processing flow to mix the material into the cuttings and to bioremediate and/or reduce the toxicity of the cuttings. In one specific example, the surfactant and/or bioremediation agent are introduced into the drill cuttings after the cuttings are processed with the dryer, shakers, centrifuges or other cuttings drying systems. In one implementation, cuttings are treated immediately after the cuttings are generated from drilling to reduce the amount of absorption of oil or chemicals into the drill cuttings. FIG. 1 is a diagram of one possible example of a drill cuttings treatment system. FIG. 2 is a process flow diagram illustrating one possible method of treating drill cuttings.

Referring now to FIGS. 1 and 2, drill cuttings from a borehole are first introduced and processed in a shaker (or shakers) 10 or some other form of separator (operation 100). The shaker begins the process of separating some or all of the drilling fluid (or mud) from the drill cuttings. Drilling fluids can and are typically reused or otherwise recycled. Separation thus allows the drilling fluids to be treated and processed separately from the drill cuttings. Below the shaker, is a cuttings bin 12. Material falling from the shaker is either directly deposited in the cuttings bin or, when a bypass door 13 is lowered, is conveyed using a cutting conveyance system 14 or otherwise moved with some mechanism to a subsequent processing step. In some instances, an operator may not want material processed through the entire system, because a component of the system may need repair, maintenance, etc. In such instances, the door is positioned so that the material falls directly into the bin. In such instances, the material may be stored for processing at a later point in time without affecting the drilling operation.

After the shaker, the material may be processed by a cuttings dryer 16 (operation 110), when the bypass door is positioned so that material does not drop into the cuttings bin. Here, the conveyor carries the drill cuttings to the dryer. However, like the bin, the cuttings may also bypass 17 the dryer and proceed to either a mixing (operation 120) or a centrifuge operation (operation 130), discussed below. The dryer spins or otherwise separates liquids from the hard (solid) cuttings. Generally speaking, the drill cuttings include some liquids, such as the drilling fluids, and different size hard materials ranging from those with a sandy consistently to larger cubic inch size solid materials. Finer cuttings and some liquids may not be processable by the dryer. In either a dryer bypass configuration 17 or after processing by the dryer, the dried cuttings are deposited or otherwise provided to a mixing mechanism 18 (operation 120).

The mixing mechanism serves to mix the processed cuttings with a bioremediation agent and/or surfactant. Various such bioremediation agents are shown and described in U.S. application Ser. No. 13/363,063 titled "Compositions and Methods for Waste Bioremediation" filed on Jan. 31, 2012, which is hereby incorporated by reference herein, and now issued as U.S. Pat. No. 8,389,270. Generally speaking, the material described in the '063 application involves a wood particle made from pine infested with the mountain pine beetle. The wood particles are surprisingly efficient and effective in treating hydrocarbon waste. More detail concerning the wood particles is set forth below. Mixing with a surfactant, which may be carried in an aqueous solution, serves to wash the drilling fluid from the cuttings. Depending on various factors, including the type of drilling fluid used, it may be sufficient to process the cuttings with a surfactant to reduce toxicity back to within acceptable levels. In some instances, it may not be sufficient, and some form of bioremediation processing may also or may only be needed. Drilling fluid is a complex—and often propriety—mixture of chemicals. The components of drilling fluid exhibit varying levels of toxicity to the surrounding environment, and the toxicity of a particular drilling fluid depends on, for example, which of these components is present and the ratio of those components within the drilling fluid. Often, drilling fluid may contain various hydrocarbons. Even drilling fluids which comprise low-toxicity compounds may contain small amounts of toxic agents. Examples of such agents include mud thinners (such as chrome lignosulfate and polycarboxylic acid salts), bactericides (such as isothiazoline and paraformaldehyde), lubricating compounds and spotting fluids (such as mineral oil and diesel), and hydrogen sulfide scavengers (such as zinc oxide). Within the drilling fluids, the strength of several toxicants is diminished, such that at the same concentration of toxicant, the resulting toxicity was higher in the natural water in the surrounding environment than in drilling fluid itself. Thus, drilling fluids may be prepared and maintained with potentially toxic substances and meet effluent discharge limitations so long as the toxicity is measured and controlled, and disposal of the drilling fluid is regulated. Aspects, alone or in combination, of the present systems and processes, reduce the toxicity of drilling fluid, and can reduce toxicity to within acceptable levels.

The mixing mechanism, which may be a pug mill, paddle auger, conveyer/shaker, or other suitable device, receives both the bioremediation agent (operation 140) and/or surfactant and the cuttings from the dryer (or directly if the dryer is bypassed) and mixes the materials. The agent and/or surfactant may be stored in a hopper 20 or other container positioned adjacent to the cuttings dryer. The cuttings are mixed with the bioremediation agent and/or surfactant such that the surfactant may wash some hydrocarbons from the cuttings and the bioremediation agent may then bioremediate a percentage of any remaining hydrocarbons in the cuttings.

Some material from the dryer, such as some liquids and finer cuttings, may also be subsequently processed in a centrifuge 22 (operation 130). Again, the material is conveyed in some manner from the dryer to the centrifuge. Material from the centrifuge, like material from the dryer, may be mixed with the bioremediation agent and/or surfactant. The processed waste cuttings mixed with the bioremediation agent are then deposited in the cuttings bin 12 for subsequent disposal or other processing (operation 150). By mixing the waste cuttings with the bioremediation agent, the waste cuttings are bioremediated. It is believed that the microorganisms left in the wood infested by mountain pine beetles are able to metabolize the hydrocarbon that are on and in the cuttings mixed with the bioremediation agent. It should be noted that the agent may also serve to stabilize and solidify the cuttings. While one embodiment herein involves mixing the cuttings with a bioremediation agent, it is also possible to mix other material into the cuttings with the processes discussed herein.

FIGS. 3-6 illustrate various views of a trailer 30 configured to provide a mobile cuttings treatment system according to various aspects of the present disclosure. The mobile system may include a pump that pumps cuttings to a dryer. The cuttings may be received directly from shakers at the rig. At the dryer, the cuttings are processed to separate the drilling fluid from the cuttings. The spent water based drilling fluid or other water can be used to rehydrate the bioremediation agent. Drilling fluid may be recycled or used to wet the cuttings prior to drying the cuttings. The dried cuttings may then be stored for post processing and/or immediately mixed with a bioremediation agent and/or a surfactant or other active or inactive agent.

One advantage of the mobile cuttings system is that it may be positioned to directly received cuttings from a drilling operation, and then process those cuttings while they are still warm, thereby avoiding several concerns with conventional systems where cuttings are typically placed in bins for a period of time, often hours, prior to any form of drying. In such conventional systems, particularly in cold climates, the cuttings become sticky and sludge-like and difficult to process in a dryer as the cuttings may clog dryer components, require more frequent maintenance of the dryer, and otherwise negatively affect the performance of the dryer. Moreover, the immediacy of treatment provides for the ability to take advantage of the heat retained in the drilling fluid separated from the cuttings in the dryer. Moreover the immediate processing does not allow time for the oil or chemicals to absorb into the cuttings therefore reducing the toxicity of the cuttings. Some drilling fluid may then be recycled and reused, and some drilling fluid may also be used to wet the cuttings prior to being dried. While seemingly counterintuitive (i.e., to wet something prior to drying), initial testing indicates that processing with a dryer reduces initial toxicity therefore making it easier to bioremediate cuttings to regulatory acceptable levels. It is also possible to circulate the warm drilling fluids extracted and use as a heat source to warm cuttings that may be used to moisten the drill cuttings prior to drying or used to moisten processed (dry cuttings) being bioremediated with pine beetle wood particles.

Another advantage, among possibly many, of the mobile treatment system, as well as the treatment system illustrated in FIG. 1, is that the immediacy of treatment of the drill cuttings, as opposed to an intermediate step of storage and then treatment, allows for treatment of the cuttings with a bioremediation agent and/or surfactant. The contaminates do not have time to adsorb deep into the pores of the cuttings thereby making such treatments more effective. In essence, the longer the cuttings soak or are exposed to drilling fluid, the deeper the fluid may penetrate into pores. Hence reducing the time exposed to fluid, reduces the depth of pore penetration by the drilling fluid.

Referring more particularly to FIGS. 3-6, various views of a trailer-based drill cuttings treatment system 30 is illustrated. First, FIGS. 3-5F illustrate the trailer-based (mobile) treatment system in a hauling configuration. In contrast, FIGS. 6A-6D illustrate the mobile treatment system in an operating orientation. For towing, a hitch 32, which may be a king pin portion of a hitch, is used to connect the mobile treatment system to a tractor trailer or other vehicle to tow the trailer to a well. When the trailer is hitched, the rear wheels (34, 36) are both supporting the trailer and the front of the trailer is suspended and hitched to the truck. When in its operating orientation, the bottom of the trailer rests on the ground, and a rear most wheel set 36 is pivoted off the ground.

In its trailering configuration, the system has a dryer 38 secured under a dryer tower 40 and aligned with an opening 42 of the dryer tower. Opposing side rails 44 of the dryer tower, which are supported by corner legs 46A-46D, support a set of mounts 48A-48D. When the trailer is positioned at a drill rig to receive drill cuttings directly from a chute off the rig, the dryer may be lifted up into the tower and supported on the mounts 48A-48D. In one example, the dryer is supported by support members, clips, pins, or like. The supports may be dimensioned to fit on and between the mounts 48A-48D. The dryer may be lifted and positioned using a fork lift, in one possible example. The pre-positioning of the dryer under the tower and aligned with the tower opening makes its such that a fork lift operator may position the forks, lift the dryer, and set the dryer on the mounts, with little or no lateral movement of the fork lift.

For operation, the trailer is positioned so that a sink 48 portion of the trailer, above the rear wheels (34, 36), is positioned under a chute 50 delivering drill cuttings from a well drilling rig. The sink defines a four-wall enclosed structure with a sloped floor 52 that delivers the cuttings to a drain 54 and pipe 56, or other conveyance mechanism, where the cuttings are then delivered to a pump 58. In this example, the pump is hauled inside the trailer and then positioned at the drain pipe to receive drill cuttings from the sink. Drill cuttings coming directly from the well are delivered into the sink 48 from the chute 50. In one possible operating condition, the drill cuttings are directly fed to the sink from an operating well such that the drill cuttings are warm. While preferable, it is also possible to process cuttings that have been stored at a site, or otherwise, such as by using a loader or other mechanism to dump cuttings into the sink. For proper flow of cuttings to the pump and operation of the pump, it may be helpful to mix the cuttings in the sink with additional fluid, such as recycled drilling fluid from the dryer or with water and/or surfactant.

From the sink, the drill cuttings are pumped to the dryer 38 positioned in the dryer tower 40 where the dryer separates as much fluid (e.g., drilling fluid) from the cuttings as possible. The dryer is positioned to drop dried cuttings into a large bin area 60 defined by the floor of the trailer, in front of the sink 48, and side walls 62 of the trailer. The tower defines a platform 64 accessible with a removable ladder 66. The platform is adjacent the area where the dryer is suspended above the floor bin. In this arrangement, the majority of the trailer floor, from the sink forward to the front end of the trailer may be used as a storage bin.

Moreover, a front wall 68 of the sink may be removable such that cuttings falling into the sink may bypass the pump and dryer and simply fill into the storage bin area 60. Such an arrangement allows for the trailer to remain in position to accept cuttings from a drilling operation even if there is some form of repair or maintenance being performed on a component of the treatment system, such as the dryer or pump. Hence, drilling operations may continue without interruption. The cuttings flowing into the bin 60 may then be processed in the dryer 38 when the system is operational. In an operation where warm cuttings are being processed, it is possible to mix in the untreated cuttings (that bypassed the drying operation) into the warm cuttings, and then process the mixed batch collectively through the dryer. Such a step will not reduce the pore depth penetration of the fluids into the stored cuttings but it will enhance the efficiency of the dryer relative to cold cuttings, and the amount of bypass material being mixed may be done to maintain a high proportion of non-bypass material relative to bypass material such that the collection of mixed cuttings meets state or other toxicity regulations.

One advantage of immediately processing cuttings is that they remain warm. In cold temperature conditions, warm cuttings are more efficiently processed by a dryer and require less dryer maintenance as compared to cuttings that have cooled. Moreover, immediately processing cuttings gives oil, cutting fluid, and other fluids less time to saturate into pores of the cuttings. Generally speaking, saturated cuttings are more difficult to clean and/or bioremediate as fluids more deeply penetrate into pores becoming less accessible by surfactants and/or bioremediation agents.

Figure 7:
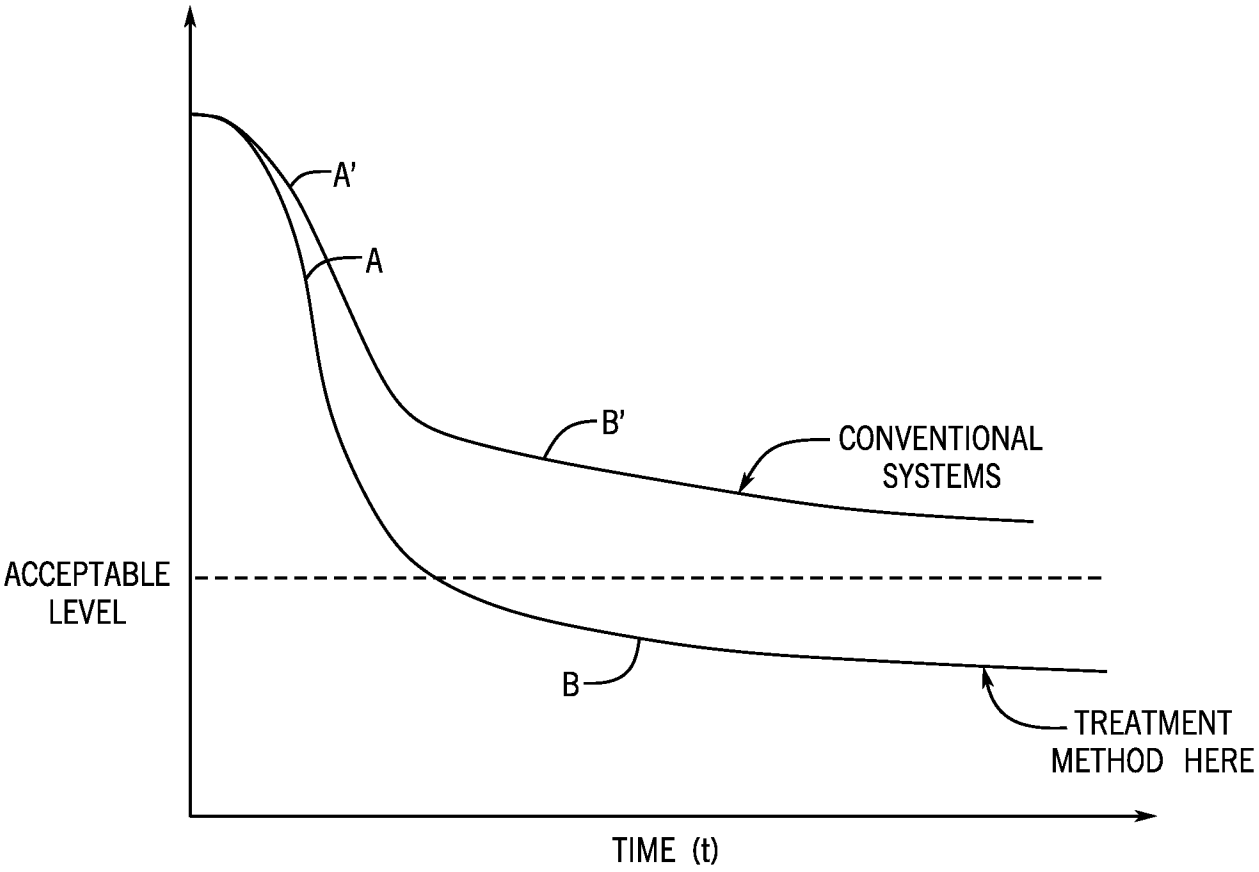
FIG. 7 is a process flow diagram illustrating one possible method of treating drill cuttings, which may be implemented using the mobile system of FIGS. 3-6, according to one embodiment.

FIG. 7 is a graph illustrating a comparison between treating cuttings with a conventional operation, where cuttings are not immediately processed while warm and without a pine beetle based bioremediation agent mixed into the cuttings. Generally speaking, the curve illustrates the toxicity of the dried cuttings over time as compared between a conventional dryer only operation and the present system. In area A versus A' (conventional), it can be seen that the toxicity initially lowers more dramatically as there was less pore penetration and better separation efficiency by the dryer. Further, in area B versus B' (conventional), it can be seen that the presence of pine beetle agent causes the toxicity levels to reach and fall below a threshold toxicity level (represented by dashed line), which may be a legally mandated level at which drill cuttings must fall below in order to be left on site or placed in a land fill, and/or are otherwise deemed to be within safe levels. While a conventional system may be able to reach and fall below a required toxicity level, the present system is able to achieve the result more quickly. Moreover, the present system is able to achieve the result more quickly with or without the added use of bioremediation agents like the pine-beetle wood particles.

Turning again to the drill cuttings treatment process provided by the current system, to further enhance performance of the process, fluid may be introduced into the cuttings in the sink prior to drying. Counter-intuitively, in one possible treatment process using the systems discussed herein, fluid is added to the cuttings in order to allow the cuttings to be dried to a greater extent in the dryer. It has been found that a range of about 45-95% aqueous cuttings solution, and around 50 to 70% being one possible optimal mix (on a volume basis), allows the dryer to operate more effectively and cuttings to flow from the sink to the pump more effectively. In essence, the process involves first wetting the cuttings with recycled drilling fluid from the dryer to make the cuttings ultimately dryer (achieve more separation in the dryer by keeping the dryer screen clean and keep it from blinding off). Moreover, in some cases, the system takes advantage of warm fluids, including separated drilling fluid from the dryer, being diverted to the sink to further wet the cuttings coming from the well with recycled drilling fluid. Additionally, the aqueous cuttings solution allows the cuttings to be pumped. Most pumps do not operate well with solid materials. The addition of fluid into the cuttings in effect allows the cuttings to flow in an aqueous carrier (e.g. the introduced recycled drilling fluid) so that the mixture flows to the pump and can be pumped. Hence, an optimal mixture of cuttings and fluid is one that allows the pump being used to properly function.

Turning now to the dryer, drill cuttings are pumped up from the sink to the dryer. As mentioned above, the sink has a drain and pipe that delivers the cuttings to the pump. The dryer defines a enclosure where the cuttings are pumped, and the enclosure spins to separate the hard cuttings from the drilling and other fluids. The cuttings are spun against a fine screen, or other perforated or holed surface, that allows fluids to flow through the screen and retains the hard cuttings in the enclosure. Both the warmth of the cuttings and the wetness of the cuttings help keep the cuttings from sticking and "blinding-off" the screen. Stated differently, cold and semi-dry cuttings form a tar-like/sticky substance that tends to plug the fine holes in a screen, and tends to render internal scraping mechanisms of the dryer less efficient in cleaning off the screen. Over time, the screen plugs to a point where it must be shut down, and opened up to manually clean the screen.

After the dryer, the dried cuttings may pour into a storage bin where a surfactant and/or bioremediation agent may be mixed into the cuttings. The dried and treated cuttings may then be removed from the bin for some other step. For bioremediation, a bioremediation agent such as those discussed in U.S. application Ser. No. 13/363,063, introduced earlier, may be mixed into the dried cuttings (cuttings solids). The treated cuttings may then be moved, on site or off site, where they are bioremediated. One advantage of the process discussed herein, is that that the drill cuttings may be dried soon, perhaps within minutes, of flowing into the sink from the bore hole. In such a situation, the cuttings are less saturated with fluids before they are dried. This results in at least two advantages mentioned earlier. One, drilling fluid saturates less deeply into the pores of the cuttings. Two, the dryer is more efficient at separated the cutting fluid from the drill cuttings. In both instances, the processing makes the interaction with the bioremediation agent more effective as the bioremidiating microbes have less material to bioremediate and can access a higher portion of the material requiring bioremediation as the material is closer to or on the surface of the cuttings. This advantage is illustrated, at least in part, by the curve comparison of FIG. 7.

With respect to surfactant, depending on the interaction of the surfactant with the bioremediation agent and its effect on the agent, the surfactant may be used to clean the cuttings prior to treatment with the bioremediation agent or may be mixed with the dried cuttings and the bioremediation agent. In some instances, water may be used to rinse the surfactant from the cuttings prior to treatment with the agent. Additionally, water may be mixed with the bioremediation agent to optimize the effectiveness of the bioremediation agent.

In various embodiments, the surfactant may be a alkylaryl polyether alcohol, such as Triton™ X-100, Surfonic™ N-100 (nonoxaynol-10), or Witconol™ NP-100; or a poloxamer, such as Pluronic™, Synperonic™, or Kolliphor™. Other suitable examples of surfactants include, for example, 2-acrylamido-2-methylpropane sulfonic acid, alkyl polyglycoside, ammonium perfluorononanoate, benzalkonium chloride (BAC), benzethonium chloride (BZT), 5-bromo-5-nitro-1,3-dioxane, cetyl trimethylammonium bromide (CTAB, hexadecyltrimehtylammonium bromide, cetyl trimethylammonium chloride), cetylpridinium chloride (CPC), cyclohexyl-1-hexyl-maltopyranoside, decylmaltopyranoside, decyl polyglucose, dimethyldioctadecylammonium chloride, dioctadecyldimethylammmonium bromide (DODAB), dipalmitoylphosphatidylcholine, lauryldimethylamine oxide, dodecylmaltopyranoside, magnesium laureth sulfate polyethoxylated tallow amine (POEA), octenidine dihydrochloride, octylphenoxypolyethoxyethanol (Igepal™ CA-630), octylthioglucopyranoside (OTG), ox gall, sodium nonanoyloxybenzensulfonate, sorbitan monolaurate, surfactin, and thonozonium bromide.

The inventor has made the discovery that wood particles derived from a mountain pine beetle-infected wood source are surprisingly able to bioremediate hydrocarbon waste more effectively than wood particles derived from other sources. Mountain pine beetles infect certain trees by laying eggs under the bark. The mountain pine beetles apparently evade normal tree defenses due to various microorganisms with which they have symbiotic relationships. Without being bound by theory, it is believed that microorganisms associated with the mountain pine beetles are able to metabolize hydrocarbon waste that has been solidified and stabilized using wood particles. Wood particles comprising mountain pine-associated microorganisms, therefore, may be used for the bioremediation of hydrocarbon waste or other pollutants.

1. Wood Particle

Provided herein is a wood particle, which may comprise a microorganism associated with a mountain pine beetle (MPB). As used to describe a microorganism contained in the wood particle, "comprise," means that the microorganism is alive, in a dormant state, or dead. The dead microorganism may comprise an enzyme or chemical that has an activity for bioremediating hydrocarbon-containing waste. The microorganism may be the blue stain fungus *Grosmannia clavigera*, which may be introduced into the sapwood of an infected tree by a mountain pine beetle. The microorganism may also be *Ophiostoma clavigerum, Ophiostoma montium, Leptographium longiclavatum, Entomocorticium, Entomocorticium dendroctoni, Ophiostoma montium, Ceratocystiopsis manitobensis, Pichia capsulate, Pichia scolytii, Pichia holstii, Bacillus subtilis, Pseudomonas*, or *Alcaligenes faecalis.*

The wood particle may be derived from any wood source affected by a MPB. The MPB may affect the wood source by killing it, or substantially killing it. Mountain pine beetles infect trees by laying eggs under the bark. The beetles may introduce a symbiotic microorganism into the sapwood that prevents the tree from repelling and killing the attacking beetles with tree pitch flow. The microorganism may also block water and nutrient transport within the tree. On the tree exterior, this results in popcorn-shaped masses of resin, called "pitch tubes," where the beetles have entered. The joint action of larval feeding and microorganism colonization kills the host tree within a few weeks of successful attack. When the tree is first attacked, it remains green. Usually within a year of attack, the needles will have turned red. In three to four years after the attack, very little foliage is left. Although the beetles may leave the tree to infect other tree hosts, a symbiotic microorganism may remain in the tree, and may be typified by a blue-gray staining of the wood. The wood source may be a lodgepole pine, ponderosa pine, Scotch pine, whitebark pine, limber pine, Douglas-fir, blue spruce, *Pinus contorta*, beech, western scrub, north coast scrub, or a sand, shore or knotty pine.

The moisture content of the wood particle may be adjusted by taking into account the degree of drying of the wood source. A wood source that is not dry enough may be difficult to manufacture into a wood particle. As used herein, "moisture content" is calculated by the formula $(A-B)/B\times100\%$, where A is the mass of the wood particle and B is the oven-dry mass of the wood particle (e.g., after drying for 24 hours at 103+/−2° C.). The timber of living trees and freshly felled logs contains a large amount of water, which often constitutes over 50% of the woods' weight. The wood particle may have a moisture content of at least 4%, 5%, 6%, 7%, 8%, 9%, 10%, 11%, 12%, 13%, 14%, 15%, 16%, 17%, 18%, 19%, 20%, 21%, 22%, 23%, 24%, 25%, or any range thereof. In addition to a minimum moisture content, or in lieu thereof, the wood particle may have a moisture content of less than 25%, 24%, 23%, 22%, 21%, 20%, 19%, 18%, 17%, 16%, 15%, 14%, 13%, 12%, 11%, 10%, 9%, 8%, 7%, or any range thereof. Therefore, the moisture content of the wood particle may be from about 5% to about 10%, from about 5% to about 15%, from about 5% to about 20%, or from about 5% to about 25%. The moisture content of the wood particle may not be lower than 4%, and is not higher than 25%.

The size of the wood particle may be adjusted taking into account the intended application. For example, wood particles that are too small may not effectively disperse in certain environments, for example drill cuttings. On the other hand, small wood particles are useful in aqueous environments such as oil spills and filtering medium by forming small oil particles with high surface to volume ratios. Wood particles with desired maximum and/or minimum particle sizes may be obtained by using screens or other size separation technology known in the art. The wood particle may be relatively small, which may be a width smaller than approximately 1/32 to 1/16 inches. The wood particle may also be relatively large, which may be a width larger than approximately 3/8 to 1/2 inches. The wood particle may also be of mid-size, which may be a width between approximately 1/16 and 3/8 inches, between approximately 1/32 and 1/2 inches, or between approximately 1/4 and 1/8 inches.

2. Composition Comprising Plurality of Wood Particles

Also provided herein is a composition comprising a plurality of the wood particle, which may be of a uniform moisture content, size, and wood source. The composition may also comprise a mixture of wood particles of differing particular moisture contents, sizes, or wood sources. Depending on the intended application of the composition, the composition may comprise additional components to achieve desired performance features. Alternatively or in addition thereto, such components may be added to the waste site in combination with the composition of wood particles.

The additional component may be a nitrogen source, such as ammonia or urea. The component may also be an inorganic chemical that facilitates bioremediation, such as gypsum or other calcium salt, magnesium, or phosphorous. The component may also be an oxygen source, such as air, or an organic or inorganic peroxide. The component may also be a microbial growth accelerator, which increases the growth of a microorganism in the wood particles. The accelerator may comprise a source of live organisms, carbon, nitrogen or phosphorous to amend inorganic nutrient deficiencies and improve microbial growth. The accelerator may also provide an organic acid, such as oxaloacetic acid, pyruvic acid, acetic acid, citric acid or tartaric acid; an amino acid, such as cysteine, methionine, glycine, or lysine; or a vitamin, such as thiamine. An example of an accelerator is the BI-CHEM® ACCELERATOR series (available from Sybron Biochemicals Inc., Birmingham, N.J.).

The composition may not include a wood particle that has a moisture content other than at least 4%, 5%, 6%, 7%, 8%, 9%, 10%, 11%, 12%, 13%, 14%, 15%, 16%, 17%, 18%, 19%, 20%, 21%, 22%, 23%, 24%, 25%, or any range thereof. The composition may also not include a wood particle that has a moisture content of other than less than 25%, 24%, 23%, 22%, 21%, 20%, 19%, 18%, 17%, 16%, 15%, 14%, 13%, 12%, 11%, 10%, 9%, 8%, 7%, or any range thereof. Therefore, the moisture content of any wood particle in the composition may not be outside the range of from about 5% to about 10%, from about 5% to about 15%, from about 5% to about 20%, or from about 5% to about 25%. The moisture content of any wood particle in the composition may not be lower than 4%, and may not be higher than 25%.

Substantially all of the wood particles in the composition may have a moisture content of at least 4%, 5%, 6%, 7%, 8%, 9%, 10%, 11%, 12%, 13%, 14%, 15%, 16%, 17%, 18%, 19%, 20%, 21%, 22%, 23%, 24%, 25%, or any range thereof. In addition to a minimum moisture content, or in lieu thereof, substantially all of the wood particles in the composition may have a moisture content of less than 25%, 24%, 23%, 22%, 21%, 20%, 19%, 18%, 17%, 16%, 15%, 14%, 13%, 12%, 11%, 10%, 9%, 8%, 7%, or any range thereof. Therefore, the moisture content of substantially all of the wood particles in the composition may be from about 5% to about 10%, from about 5% to about 15%, from about 5% to about 20%, or from about 5% to about 25%. The moisture content of substantially all of the wood particles in the composition may not be lower than 4%, and may not be higher than 25%.

The composition may not include a wood particle that has a width other than smaller than approximately 1/32 to 1/16 inches. The composition may also not include a wood particle that has a width larger than other than approximately 3/8 to 1/2 inches. The composition may also not include a wood particle that is outside the range of between approximately 1/16 and 3/8 inches, between approximately 1/32 and 1/2 inches, or between approximately 1/4 and 1/8 inches.

Substantially all of the wood particles in the composition may have a width smaller than approximately 1/32 to 1/16 inches. Substantially all of the wood particles in the composition may also have a width larger than approximately 3/8 to 1/2 inches. Substantially all of the wood particles in the composition may also have a width between approximately 1/16 and 3/8 inches, between approximately 1/32 and 1/2 inches, or between approximately 1/4 and 1/8 inches.

3. Producing the Wood Particles

Also provided herein is a method of producing the wood particle. Starting with a mountain pine beetle-infested wood source, the wood may be reduced in size to produce wood chips. As commonly understood, wood chips are small wood pieces of unspecified size that are ground, broken or cut from trees, logs, or larger wood pieces using equipment such as a disc chipper, drum chipper, grinder or crusher, or any other equipment known for making such product or by-product in the art. The size of wood chips sizes can vary depending on the techniques, equipment and production methods used. For example, the wood chip can have a width of saw dust to approximately 2 inches.

The wood chip may then be dehydrated, or subjected to wood drying or wood seasoning, to reduce the moisture content of the wood chip. The wood chip may be air-dried, mechanically died, friction dried, kiln-dried, or subjected to any other drying process known in the art. In the drying process, the temperature, relative humidity and air circulation may be controlled to achieve the desired amount of drying, which may be relatively uniform or consistent among individual wood chips in the same batch. Depending on the starting moisture content of the wood chip, the duration of the drying time may be adjusted accordingly. The common practice in wood dehydrating is to ensure drying timber at the fastest possible rate without causing objectionable defects such as wood collapse, distortions or discoloration. Commonly, lodgepole pine wood chips are dehydrated by heating at 200° F. for 8 hr to reach a moisture content close to 0%. By contrast, the wood chips used to make the wood particles provided herein are subjected to substantially reduced temperature and/or drying times in order to prevent excess drying of the wood, for example to keep the moisture content of the wood chip products not lower than 4%. For example, the wood chip may be dried at a temperature no more than 155° F., 160° F., 165° F., 170° F., 175° F., 180° F., 185° F., 190° F., 195° F., 200° F., 205° F., 210° F., 215° F., 220° F., 230° F., 235° F., 240° F., 245° F., 250° F., 255° F., 260° F., 265° F., 270° F., 275° F., 280° F., 285° F., 290° F., 295° F., 300° F., 305° F., 310° F., 315° F., 320° F., 330° F., 335° F., 340° F., 345° F., or 350° F., depending on the starting moist content of the wood chip to achieve a final moisture content disclosed herein. The drying time for the wood chip may be for no more than 4, 5, 6, 7, 8, 9, 10, 15, 20, 25, 30, 35, 40, 45, 50, 55 or 60 minutes, depending on the starting moisture content of the wood chip to achieve a final moisture content between 4%-25%.

The dehydrated wood chip may be densified, which may be performed prior to or after dehydration. The biomass of the wood chip may be joined together by using various treatments, such as pressure and heat. In addition, the natural lignin, cellulose or hemicellulose in the wood may form a natural binder, such that the joined and processed wood biomass forms a variety of shapes and sizes for various uses. The wood chip may also be densified by impregnating its void volume with a synthetic or natural polymer in liquid form and then solidifying by chemical reaction or by cooling of the impregnant. Alternatively, wood density can be increased by compression in the transverse direction. The processes suitable for densifying the woody biomass on a production scale can be classified into two types: pelletizing (pelleting) and extrusion briquetting, either of which may be used to produce the wood particle. General types of equipment available for wood densification include a screw-type extruder, die type extruder and a compacting ram. Wood particles produced by extrusion can be in a form of chunk, crumble, lump, hunk or other irregular masses of varying widths depending upon equipment and die geometry.

The wood particles may be fractionated based on size. For example, screens may be used to select wood particles with a desired maximum and/or minimum particle size. For example, the wood particles may be separated to widths smaller than 1/32 to 1/16 inches. The wood particles may also be separated to widths larger than 3/8 to 1/2 inches. The wood particles may also be separated to widths between 1/32 and 1/16 inches, or between 3/8 and 1/2 inches. The wood particles may also be 1/4 to 1/8 inches in width.

4. Treating Hydrocarbon Waste

Also provided herein is a method of bioremediating hydrocarbon waste by contacting the waste with the composition provided herein. The waste may be bioremediated in situ or ex situ. In situ bioremediation involves bioremediating the waste at the site where it is produced, while ex situ involves the removal of the waste to be bioremediated elsewhere, such as at the oilfield waste pits or landfill where the waste is collected and stored.

The waste being bioremediated may be from drill mud and drill cuttings from oil and gas wellbores, drill fluid or solid waste deposit sites (such as pits or landfill), oil spills on water, oil and gas production waste, or ground surfaces. The drilling fluid may be any fluid that is used in hydrocarbon drilling or production operations, including muds or other fluids that contain suspended solids, or emulsified water or oil. The drill mud may be any type of water-base, oil-base, or synthetic-base drilling fluids, including all drill-in, completion and work over fluids. The drill cuttings may be solids that are carried by the drill mud in the drilling operations, including the bits of rocks ground by the drill bits.

For bioremediating contaminated drill fluids, solids or an admixture of both, the composition may comprise wood particles with widths between approximately 1/16 and 3/8 inches, or between approximately 1/4 and 1/8 inches. Further, according to a waste site-specific condition, such as an oxygen, temperature, moisture, or nutrient parameter, the composition may further comprise a nitrogen, mineral, and/or oxygen source that facilitates bioremediation. Alternatively or simultaneously, the composition may further comprise a microbial growth accelerator comprising a source of carbon, nitrogen or phosphorous, which may amend inorganic nutrient deficiencies and improve microbial growth.

For bioremediating contaminated soil at a site, such as a drilling sink hole, oil pipeline leakage and drill fluid or solid waste pit or landfill, the composition may be applied by transferring the composition in to a hole that has been drilled into the ground soil to a predetermined depth. The composition may further comprise a nitrogen, mineral, or oxygen source. The composition may also comprise a microbial growth accelerator, which may comprise a source of carbon, nitrogen or phosphorous.

Figure 8:
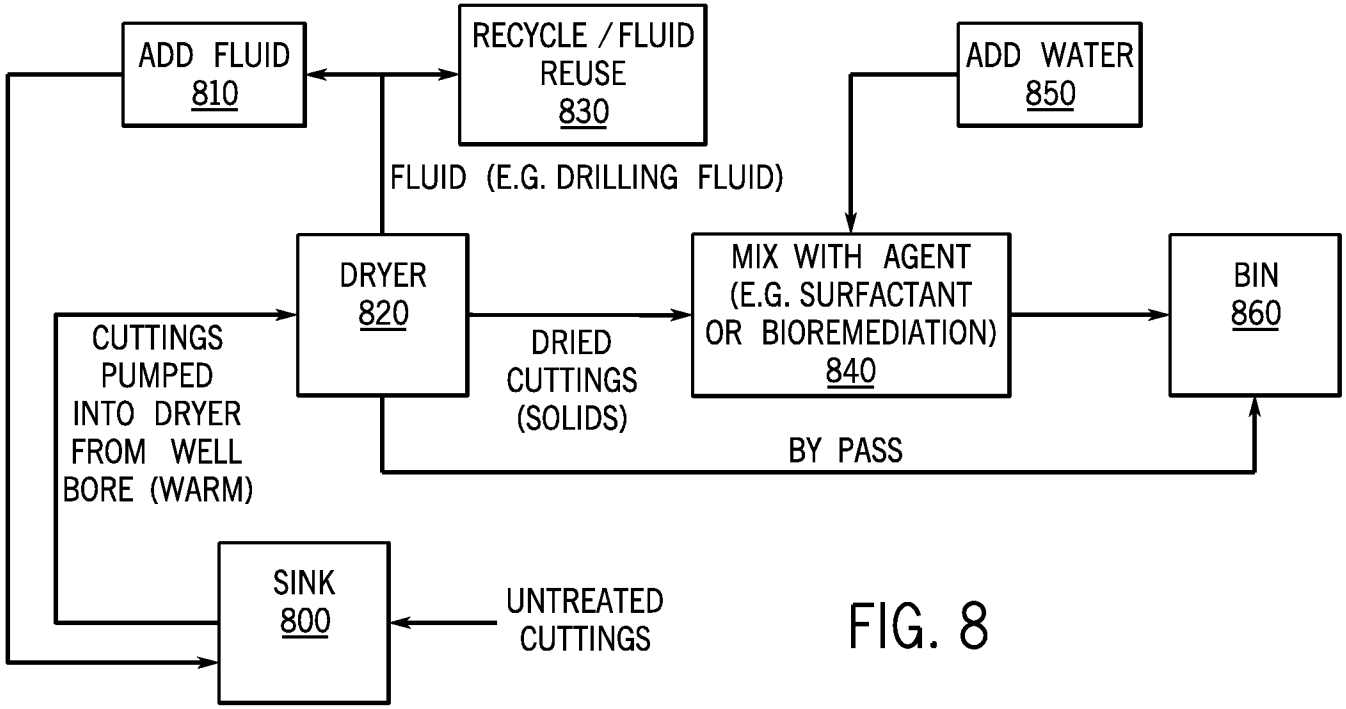
FIG. 8 is a graph illustrating one possible drill cuttings result of reaching state acceptable toxicity levels using an embodiment of the treatment systems described herein.

Returning to the operation of the mobile system, recognizing that various operations and sequences, may be changed depending on the configuration of the machine, FIG. 8 illustrates one possible processing operation where cuttings are processed in the mobile system and treated with surfactant and/or a bioremediating wood particle or other bioremediation agent. More particularly, drill cuttings are first delivered into the sink (operation 800). In the sink, recycled fluid or other fluids may be added to drill cuttings (operation 810). From the sink, the cuttings are pumped or otherwise transported to the dryer (operation 820). In the dryer, drilling fluids and other fluids are separated from hard cuttings. The separated fluids can be recycled and reused in the drilling operation (830), can be used as a wetting agent for cuttings being processed in the system (810), or may be otherwise stored or the like. The dried cuttings, which may be referred to as solids, are then ready for additional processing, storage or transport to a disposal facility. With respect to further processing, the dried cuttings are mixed with the bioremediation agent and/or surfactant (operation 840). Here, water may also be added to enhance the effectiveness of the surfactant and/or bioremediation agent (operation 850). The treated cuttings are temporarily stored in the bin portion 60 of the trailer, where they may be removed by a loader or otherwise.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. As another example, an embodiment may include features that were discussed in reference to other embodiments. Processes and methodologies discussed herein may be set out in an order; however, the order set out is merely exemplary and operations may be conducted in different orders. Accordingly, the scope of the present disclosure is intended to embrace all such alternatives, modifications, and variations together with all equivalents thereof.

I claim:

1. A drill cuttings treatment system comprising:

a drill cuttings separation mechanism configured to separate a fluid from drill cuttings; and a mixing mechanism configured to receive a bioremediation agent including wood particles derived from a mountain pine beetle-infected wood source, and mix the bioremediation agent with the separated drill cuttings.

2. The drill cutting treatment system of claim 1 wherein the drill cuttings separation mechanism comprises:

a shaker assembly that delivers the separated drill cuttings to a conveyance mechanism, the conveyance mechanism configured to deliver the separated drill cuttings to a dryer wherein the dryer further processes the separated drill cuttings and delivers the separated drill cuttings to the mixing mechanism.

3. The drill cutting treatment system of claim 2 wherein the drill cutting separation mechanism further comprises a centrifuge that receives some of the separate drill cuttings from the dryer and further processes the separated drill cuttings and delivers the separated drill cuttings to the mixing mechanism.

4. The drill cuttings treatment system of claim 1 wherein the drill cuttings separation mechanism comprises a dryer.

5. A waste treatment apparatus comprising:

a mobile platform;

a sink supported on the mobile platform, the sink configured to received waste material;

a conveyance mechanism coupled with the sink for receiving waste material from the sink, the conveyance mechanism moving the waste material to a separator; and the separator receiving the waste material and separating a portion of fluid waste from solid waste, the solid waste being deposited in a storage bin portion of the mobile platform.

6. The waste treatment apparatus of claim 5 wherein the waste material comprises drill cuttings and drilling fluid.

7. The waste treatment apparatus of claim 6 wherein the conveyance mechanism comprises a pump.

8. The waste treatment apparatus of claim 7 wherein the separator comprises a dryer, the dryer separating a portion of the drilling cuttings from a portion of the drilling fluid.

9. The waste treatment apparatus of claim 8 further comprising a conduit and valve assembly that directs a portion of the separated portion of the drilling fluid to the sink to wet the received waste material.

10. The waste treatment apparatus of claim 9 wherein the sink is positioned to directly receive waste material from a shaker of a drilling rig, the shaker providing warm waste material directly from a drilling operation.

11. The waste material apparatus of claim 10 wherein the pump delivers warm waste material to the dryer, the waste material wetted with the separated portion of the drilling fluid.

12. The waste treatment apparatus of claim 5 wherein the sink comprises a movable wall that when moved allows waste material to bypass the conveyance mechanism and flow into the storage bin portion.

* * * * *